US007794123B2

(12) United States Patent
Newbill

(10) Patent No.: US 7,794,123 B2
(45) Date of Patent: Sep. 14, 2010

(54) YIELDABLE SUPPORT FOR A MAILBOX

(76) Inventor: Anthony J. Newbill, P.O. Box 21360, Wickenburg, AZ (US) 85358

( * ) Notice: Subject to any disclaimer, the term of this patent is extended or adjusted under 35 U.S.C. 154(b) by 0 days.

(21) Appl. No.: 11/487,674

(22) Filed: Jul. 17, 2006

(65) Prior Publication Data

US 2008/0013328 A1 Jan. 17, 2008

(51) Int. Cl.
*F21S 13/10* (2006.01)
*F21S 8/00* (2006.01)

(52) U.S. Cl. ..... 362/431; 362/145; 40/608; 238/38; 238/39; 248/145; 248/146; 248/133

(58) Field of Classification Search ..... 362/431, 362/145, 153, 153.1; 248/145, 146, 133; 40/608; 238/38, 39
See application file for complete search history.

(56) References Cited

U.S. PATENT DOCUMENTS 1,249,315 A * 12/1917 Brandvold ..... 248/145
1,266,152 A * 5/1918 Poole ..... 40/608
1,269,212 A * 6/1918 Poole ..... 40/608
1,284,376 A * 11/1918 Lehman ..... 40/608
1,367,830 A * 2/1921 Poole ..... 40/608
1,384,365 A * 7/1921 Walsh ..... 40/608
1,402,465 A * 1/1922 Wood ..... 40/608
1,435,363 A * 11/1922 Wood ..... 40/608
1,435,379 A * 11/1922 Connery ..... 248/145
1,679,623 A * 8/1928 Olsen ..... 40/608
1,903,683 A * 4/1933 Nute ..... 40/608
2,949,324 A * 8/1960 Birge et. al. ..... 403/229
3,161,397 A 12/1964 Nolander ..... 248/417
3,620,496 A * 11/1971 Bolt et al. ..... 248/171
3,658,284 A 4/1972 Haasi ..... 248/145
3,899,150 A 8/1975 Racquet ..... 248/145
4,172,579 A 10/1979 Steinman ..... 248/145
4,498,657 A * 2/1985 Werner ..... 248/623
4,546,944 A * 10/1985 Cea ..... 248/219.2
4,792,088 A 12/1988 Bonnell ..... 232/17
5,029,783 A 7/1991 Alvarez ..... 248/146
5,155,470 A * 10/1992 Tuttle ..... 340/539.1
5,215,283 A 6/1993 Gould ..... 248/145
6,513,284 B1 * 2/2003 Sandlin ..... 47/66.6
7,032,811 B1 4/2006 Paulic et al. ..... 232/39

* cited by examiner

*Primary Examiner*—Jacob Y Choi
(74) *Attorney, Agent, or Firm*—Schmeiser Olsen & Watts LLC

(57) ABSTRACT

A post structure for installation along a street or road with a base supporting the post structure in a yieldable manner. A coupling joining the base and post structure includes a resilient member urging the post structure into a normal, pre-determined position on the base. An upper end of the base serves as a fulcrum for momentary post structure movement. A modified form of the yieldable support includes a housing with spring and fastener assembly with the housing having inclined surfaces which cooperate with inclined surfaces on the base upper end, insuring return of the tipped post structure back to the pre-determined relationship with the base after momentary displacement.

23 Claims, 3 Drawing Sheets

YIELDABLE SUPPORT FOR A MAILBOX

BACKGROUND OF THE INVENTION

The present invention concerns a support structure for an article such as a mailbox or other article, and those structures may yield upon being subjected to sudden impacts.

In the case of mailbox supports, such as are found in rural areas, located adjacent streets, roadways, etc., the support is often a post. Accordingly, the post and mailbox are highly susceptible to damage by snow plows, road graders automobiles, etc. Further, typical mailbox supports are most often strictly utilitarian, without regard to enhancing a home site.

U.S. Pat. No. 7,032,811 discloses a mailbox support, including a post segment terminating downwardly within a coil spring while a ground inserted secondary post segment extends upwardly, into the coil spring to permit movement of the first mentioned post segment upon impact. Provision is made for rotational displacement of a post supported mailbox about a vertical axis.

U.S. Pat. No. 4,792,088 discloses a mailbox support with post segments being spaced apart by a spring assembly, including a socket at one end and an insert at the opposite spring end for post engagement.

U.S. Pat. No. 5,029,783 discloses a post wherein upper and lower post segments are held in axial alignment by an extension spring member with ends secured to the post segments. A cover protects cooperating rings 32, 34. Variations in the action of a spring 50 entails substitution of the spring.

U.S. Pat. No. 5,215,283 discloses a mailbox support with a horizontal arm, supporting multiple mailboxes, which may swing upon impact to wind or unwind a coil spring 24 to automatically return the mailboxes to an operative position.

U.S. Pat. No. 3,161,397 discloses a mailbox supporting arm which, upon impact, may rotate to move against the action of a spiral spring, which subsequently returns to an operative position as determined by stops 27-28.

U.S. Pat. Nos. 3,658,284; 3,899,150 and 4,172,579 all include spring components for relocating a mailbox and a supporting horizontal arm in perpendicular relationship to a street or roadway but fail to show any protective means for a mailbox post against damage from an impacting force.

SUMMARY OF THE PRESENT INVENTION

The present invention is directed toward providing a sturdy support for such items as roadside located mailboxes or other structures subjected to significant forces. The present post structure may yield with substantial displacement to lessen damage to the post with return of the post structure to its normal disposition with little or no manual effort. A component of the present support structure permits momentary tipping of the post structure through a wide range of movement about multiple axes. Dual upright components of the post structure may be reinforced by a plate mounted therebetween. Inclined post members permit a wide range of travel of the support when contacted by a vehicle or other source of impact.

A modified form of the present support is particularly suitable for areas experiencing high winds that result in tipping of the support in an oscillating manner. The modified form includes cooperating surfaces on the post or base and at the lower end of the support structure which serves to maintain the post structure against rotational displacement during tipping of the support structure in response to wind or other force.

DETAILED DESCRIPTION OF THE PREFERRED EMBODIMENTS

Figure 1:
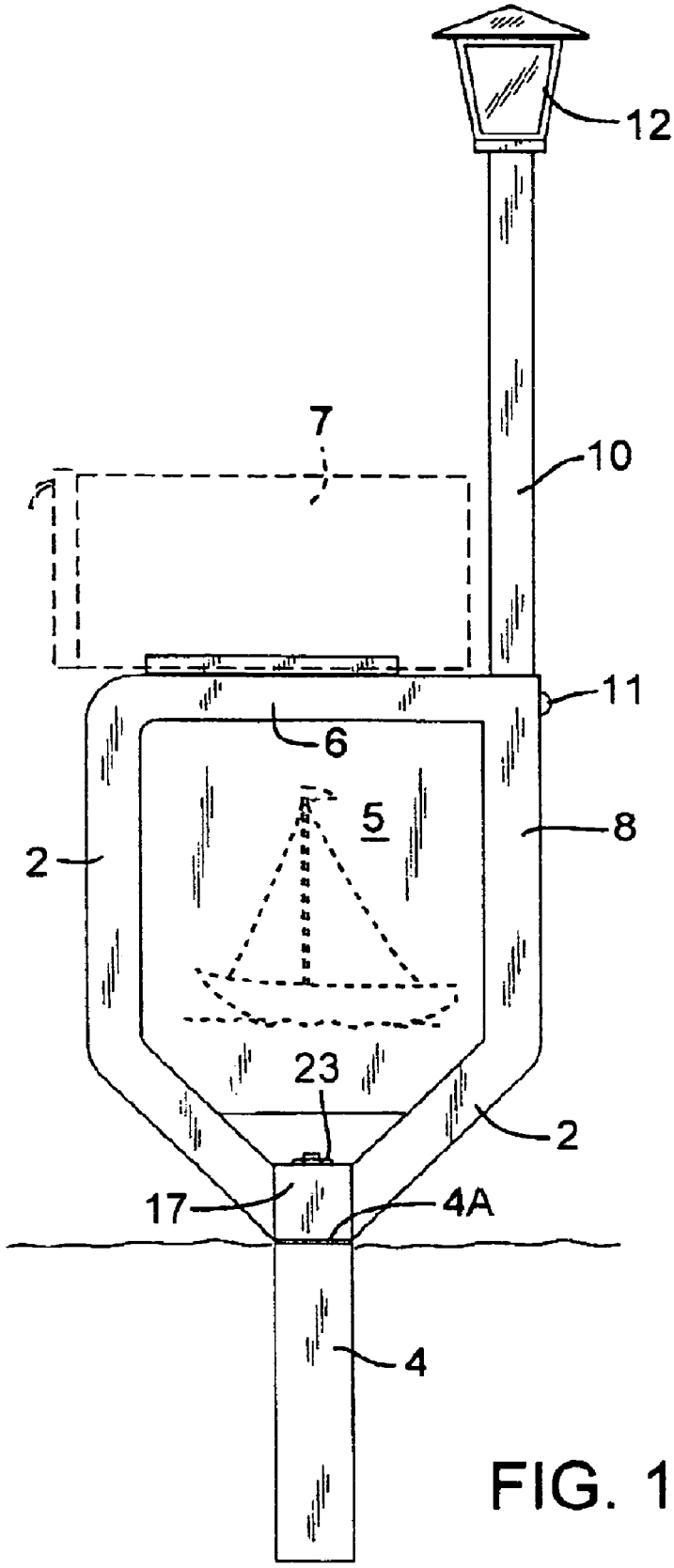
FIG. 1 is a side elevational view of the present support structure.

With continuing attention to the drawings, the applied reference numeral 1 indicates generally a support shown in conjunction with a mailbox.

A post component 2 is in supported contact with an upper end surface 4A of a base 4. Post component 2 is of tubular construction and preferably includes a reinforcing plate 5. Plate 5 may also serve decorative purposes. A horizontal post member 6 serves as a support for a mailbox 7. An upright member 8 of the post may serve to receive a light post 10 having a lower end portion in inserted engagement with the upright member and held in place as by a set screw 11. A lantern at 12 is preferably of the solar powered type to illuminate any information such as an owner's name or a street number on plate 5.

Figure 2:
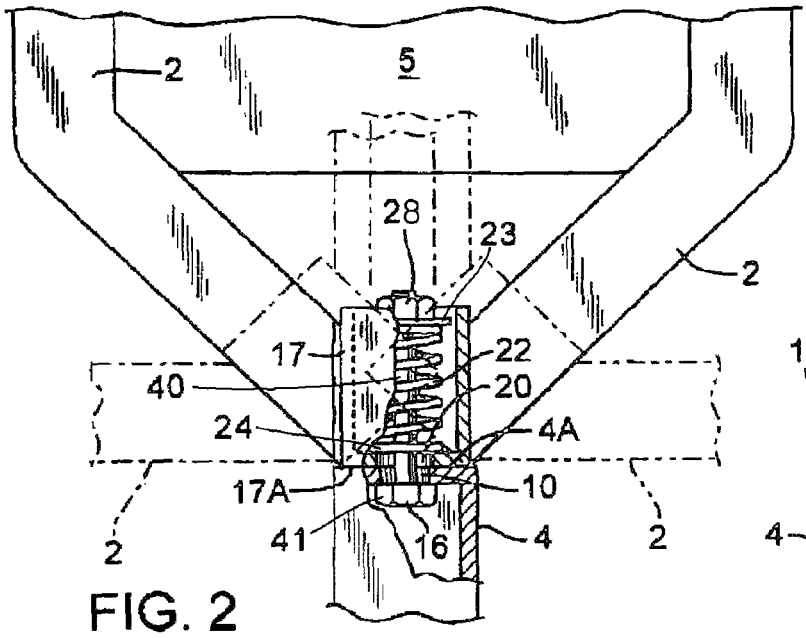
FIG. 2 is an enlarged fragmentary view of the present post structure.
Figure 3:
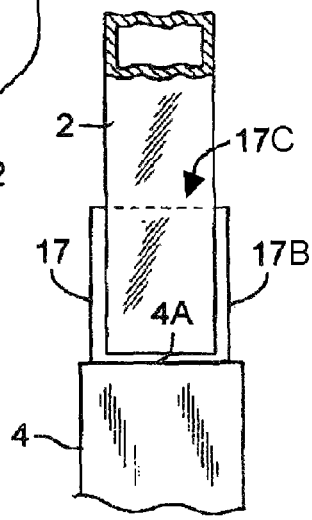
FIG. 3 is an elevational view taken along line 3-3 of FIG. 2.

Base 4 may also be of tubular construction, having top end 4A (FIG. 2) centrally apertured at 10 to receive a fastener 16. A housing 17 on post component 2 has a bottom wall 17A is in supported engagement with surface 4A of base 4. Housing bottom wall 17A is apertured at 20 to receive fastener 16 which extends upwardly through a compression spring 22 to receive a nut 28 and washer 23. Nut 28 engages washer 23. The spring bottom end is supported by end 17A of the housing. A washer 24 is positioned between spring 22 and bottom wall 17A of housing 17. Washer 24 is positioned between spring 22 and aperture 20 of housing 17. Nut 28 is threadingly engaged with the shaft 40, and washers 23 and 24 are not threadingly engaged with the shaft 40. Adjustment of nut 28 serves to urge housing 17 into frictional engagement with surface 4A of base 4. It should be noted that the openings 15, 10 and 20 in bottom 17A are oversize for the shaft 40 of fastener 16. In this embodiment, housing 17 includes a sidewall 17B which extends upwardly from bottom wall 17A. Sidewall 17B terminates proximate to washer 23 to form an upper housing opening 17C, as shown in FIG. 3. Shaft 40 extends through apertures 10 and 20 and upper housing opening 17C. Shaft 40 extends through the washers 23 and 24.

Figure 4:
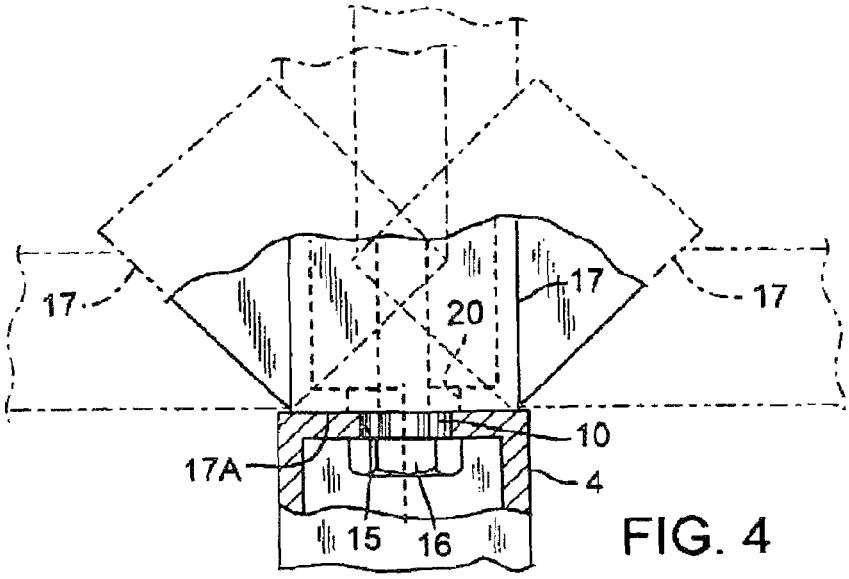
FIG. 4 is a schematic of base and post components with tipped positions of the post shown in broken lines.

With attention to FIG. 4, it will be seen that housing 17, upon a laterally applied force being applied to post component 2, will rock about a housing edge as at 23. FIG. 4 shows, in broken lines, movement of housing 17 with component 2 displaced in opposite directions and shown for illustrative purposes only. Surface 4A of base 4 functions as a fulcrum when housing 17 is displaced.

Figure 5:
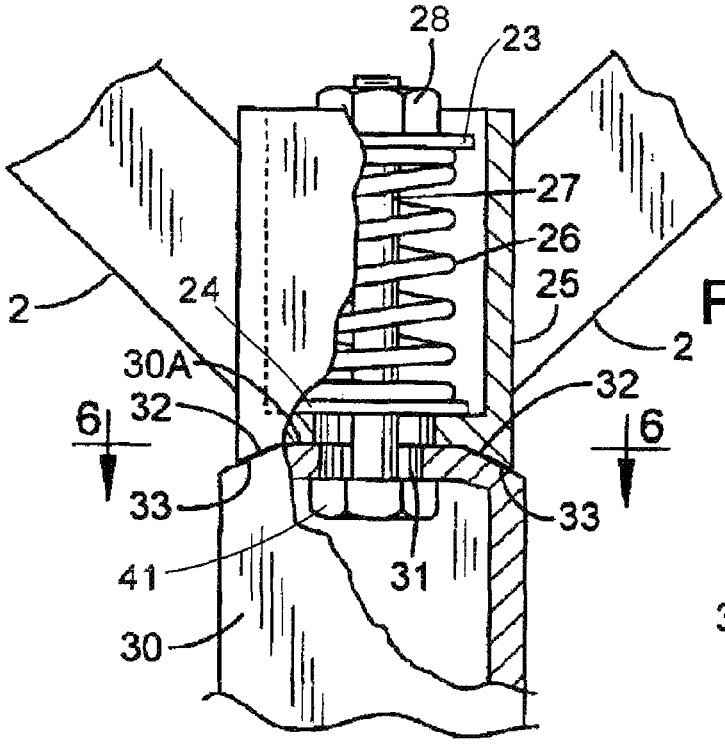
FIG. 5 is a view similar to FIG. 2 but showing a modified form of the support.
Figure 6:
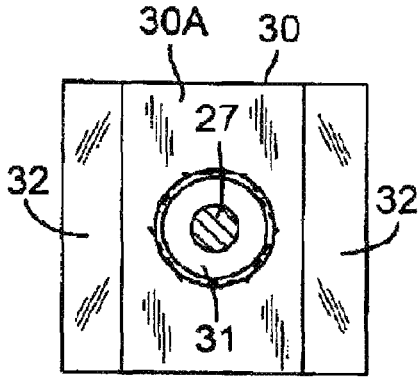
FIG. 6 is a horizontal sectional view taken along line 6-6 of FIG. 5.

With attention to FIG. 5 and FIG. 6, a modified form of the present support includes a housing 25 to house a compression spring 26 and a fastener 27 engaged with nut 28 and washer 23. Post component 2 is carried by a housing 25. A base 30 with an opening 31 receives a head 41 of fastener 27. Opening 31 is oversized so that shaft 40 can extend therethrough. With attention also to FIG. 6, it will be seen that base end 30A has inclined surfaces at 32. The inclined surfaces cooperate with housing inclined surfaces 33 with the surfaces 32 and 33 serving to return housing 25 into a pre-determined relationship with base 30 regardless of slight movement imparted to the housing during momentary tipping of post component 2 as, for example, by the wind. Accordingly, post component 2 may tip or rock in response to variable high winds but will always return to the pre-determined relationship with base 30. As in the earlier described form of the invention, the oversize openings 31 in base 30 and in housing 25 permit momentary lateral displacement of fastener 27. The immediately above described feature is of value to prevent any slight displacement of post component 2 when tipped.

While the present support has been shown and described for use in conjunction with mailboxes it will be understood that the novel support may be utilized in roadside or streetside signage to reduce replacement and/or repair costs of signs damaged by autos, trucks, etc. The post component 2, in such instances, would most likely be of linear configuration.

Figure 7:
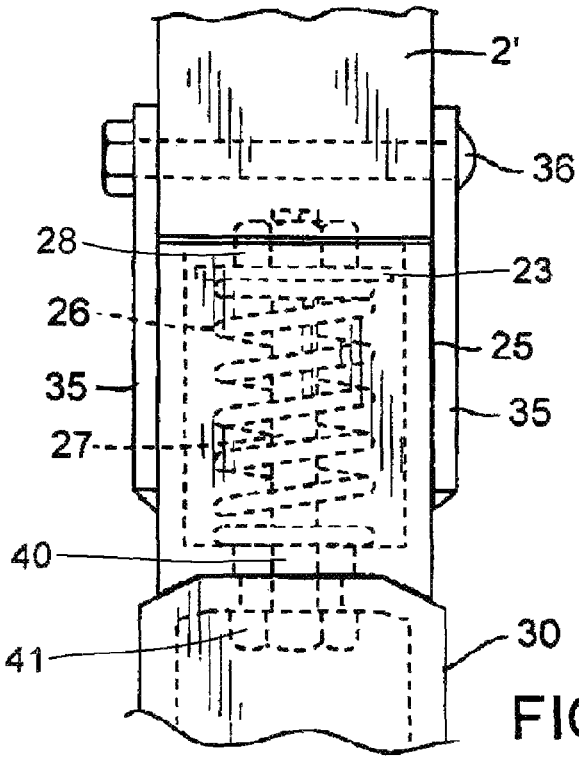
FIG. 7 is an elevational view of a support structure modified for use as a sign post.

In FIG. 7, a modified post structure 2' may be termed a sign post having a road sign thereon (not shown). Plates at 35 are carried by a housing 25 and a fastener assembly 36 couples the post lower end to the plate and the housing. Access to fastener 27 is achieved upon removal of post 2'.

While I have shown but one embodiment of the invention, it will be apparent to those skilled in the art that the invention may be embodied still otherwise without departing from the spirit and scope of the claimed invention.

Having thus described the invention, what is desired to be secured by a Letters Patent is:

1. A post structure, comprising:

a base having a base end with an opening extending therethrough, wherein the base end includes inclined surfaces;

a post component which includes a housing with a bottom wall having an opening positioned adjacent to the opening of the base, wherein the bottom wall includes included surfaces, which cooperates with the inclined surfaces of the base end;

a fastener which extends through the base and bottom wall openings, and a washer engaged with the fastener; and a spring positioned so the fastener extends therethrough, the spring being biased between the bottom wall and washer so the bottom wall is held to the upwardly facing surface of the base; and a mailbox and light post carried by the post component.

2. The post structure of claim 1, wherein the post component includes a reinforcing plate, wherein the reinforcement plate is spaced apart from the housing.

3. The post structure of claim 1, wherein the spring is positioned within the housing.

4. The post structure of claim 1, wherein the spring is not positioned within the base.

5. The post structure of claim 1, wherein the spring extends through the housing.

6. The post structure of claim 1, wherein the spring does not extend through the base.

7. The post structure of claim 1, wherein the post component includes opposed upright members extending upwardly from the housing.

8. The post structure of claim 7, further including a horizontal post member extending between the opposed upright members.

9. The post structure of claim 8, further including a plate which extends between the opposed upright members and horizontal post member.

10. The post structure of claim 7, further including a light post received by one of the opposed upright members.

11. The post structure of claim 8, further including a mail box carried by the horizontal post member.

12. The post structure of claim 1, further including a light post carried by the post component.

13. The post structure of claim 1, wherein the housing includes a sidewall which extends upwardly from the bottom wall, the sidewall terminating proximate to the washer to form an upper housing opening.

14. A post structure, comprising:

a base having a base end with an opening extending through it, wherein the base end includes inclined surfaces;

a post component which includes a housing with a bottom wall having an opening positioned adjacent to the opening of the base, wherein the bottom wall includes inclined surfaces which cooperates with the inclined surfaces of the base end;

a rigid fastener which extends through the base and bottom wall openings, and a washer engaged with the rigid fastener;

a spring positioned so the rigid fastener extends through it, the spring being biased between the bottom wall and washer so the bottom wall is held to the upwardly facing surface of the base;

a mailbox and light post carried by the post component.

15. The post structure of claim 14, wherein the spring is compressed in response to tilting the rigid fastener.

16. The post structure of claim 15, wherein the dimensions of the base and housing openings determine how much the rigid fastener is allowed to tilt.

17. The post structure of claim 15, wherein the dimensions of the base and housing openings determine how much the housing is allowed to tilt.

18. The post structure of claim 14, wherein the spring is compressed between the bottom wall and washer in response to tilting the rigid fastener.

19. The post structure of claim 14, wherein the spring is compressed in response to tilting the housing.

20. The post structure of claim 14, wherein the spring is compressed between the bottom wall and washer in response to tilting the housing.

21. The post structure of claim 20, wherein amount of compression of the spring between the bottom wall and washer is adjustable in response to adjusting the nut.

22. The post structure of claim 20, wherein the amount of friction between the base and housing is adjustable in response to adjusting the nut.

23. The post structure of claim 14, further including a nut threadingly engaged with the rigid fastener.

* * * * *